US010302255B2

(12) United States Patent
Hughes et al.

(10) Patent No.: US 10,302,255 B2
(45) Date of Patent: May 28, 2019

(54) EQUIPMENT COMPRISING AT LEAST ONE HYDROPNEUMATIC ACCUMULATOR WITH AUTOMATED MAINTENANCE

(75) Inventors: Thomas Hughes, Newry (IE); Alain Houssais, Andilly (FR); Laurent Granseigne, Courbevoie (FR)

(73) Assignee: PARKER HANNIFIN MANUFACTURING FRANCE SAS, Annemasse (FR)

( * ) Notice: Subject to any disclaimer, the term of this patent is extended or adjusted under 35 U.S.C. 154(b) by 0 days.

(21) Appl. No.: 14/003,691

(22) PCT Filed: Mar. 7, 2012

(86) PCT No.: PCT/FR2012/050477

§ 371 (c)(1),
(2), (4) Date: Nov. 8, 2013

(87) PCT Pub. No.: WO2012/146837

PCT Pub. Date: Nov. 1, 2012

(65) Prior Publication Data

US 2014/0102551 A1 Apr. 17, 2014

(30) Foreign Application Priority Data

Mar. 9, 2011 (FR) ..... 11 51934

(51) Int. Cl.
*F15B 1/08* (2006.01)
*F17D 1/00* (2006.01)

(52) U.S. Cl.
CPC ..... *F17D 1/00* (2013.01); *F15B 1/08* (2013.01); *F15B 2201/205* (2013.01);
(Continued)

(58) Field of Classification Search
CPC .. E21B 33/0355; E21B 33/064; E21B 33/085; E21B 34/16; E21B 21/001;
(Continued)

(56) References Cited

U.S. PATENT DOCUMENTS 2,707,002 A * 4/1955 Harris ..... 138/31
4,088,154 A 5/1978 Patton et al.
(Continued)

FOREIGN PATENT DOCUMENTS

GB 2209561 5/1989
JP 49069610 9/1972
(Continued)

OTHER PUBLICATIONS

Japanese Office Action for corresponding Japanese Application No. JP 2013-557159 dated Nov. 4, 2015 (11 pages).

*Primary Examiner* — Craig J Price
(74) *Attorney, Agent, or Firm* — Hamre, Schumann, Mueller & Larson, P.C.

(57) ABSTRACT

The invention relates to the automatic reloading of the gas space of a hydropneumatic accumulator. An apparatus for readjusting the load of the gas space includes a pressurized gas source connected via an air system to a loading check-valve and a reinjection valve controlled by a unit for calculating a cycle for reinjecting gas into the gas space.

13 Claims, 4 Drawing Sheets

(52) U.S. Cl.
CPC ... *F15B 2201/4155* (2013.01); *F15B 2201/51* (2013.01); *Y10T 137/2931* (2015.04); *Y10T 137/3115* (2015.04); *Y10T 137/3127* (2015.04)

(58) Field of Classification Search
CPC ..... E21B 21/01; E21B 21/08; E21B 43/36; F04B 43/06; F04B 19/003; F04B 11/0016; F15B 19/005; F15B 1/08; F15B 1/027; F15B 1/24; F15B 2201/205; F15B 2201/4155; F15B 2201/51; G01F 23/14; G01F 19/00; F16L 55/053; F16F 9/43; G05D 16/0619; F02C 9/24; G21D 1/02; Y10T 137/3115; Y10T 137/3118; Y10T 137/3124; Y10T 137/3127; Y10T 137/3137; Y10T 137/2931; F17D 1/00
USPC ..... 137/206, 207, 208, 209, 211.5
See application file for complete search history.

(56) References Cited

U.S. PATENT DOCUMENTS 4,487,226 A 12/1984 Chun
4,694,693 A * 9/1987 Gerlowski ..... 73/168
4,714,093 A * 12/1987 Kawano ..... 138/30
4,755,111 A * 7/1988 Cocchi et al. ..... 417/394
4,781,061 A * 11/1988 Baumgartl ..... 73/149
4,832,005 A * 5/1989 Takamiya et al. ..... 600/18
6,102,673 A * 8/2000 Mott et al. ..... 417/392
6,298,767 B1 10/2001 Porter
6,481,329 B2 * 11/2002 Porter ..... 166/344
7,100,631 B2 * 9/2006 Liu ..... G05D 11/132 137/208
7,810,516 B2 * 10/2010 Gerken ..... B67D 7/0272 137/113
8,037,677 B2 * 10/2011 Fong et al. ..... 60/408
8,104,274 B2 * 1/2012 McBride ..... H02J 15/006 60/410
8,247,915 B2 * 8/2012 Crane et al. ..... 290/44
8,448,433 B2 * 5/2013 McBride ..... F15B 1/024 60/407
8,609,120 B2 * 12/2013 Heacox ..... A01K 1/12 424/1.13
9,097,357 B2 * 8/2015 Humphreys ..... E03B 11/10
2004/0084081 A1 * 5/2004 Liu ..... G05D 11/132 137/113
2004/0194336 A1 * 10/2004 Xu ..... B24B 37/04 34/558
2006/0196884 A1 * 9/2006 Gerken ..... B67D 7/0272 222/64
2008/0292483 A1 * 11/2008 De Koning ..... 138/30
2009/0282822 A1 * 11/2009 McBride ..... F15B 1/024 60/415
2009/0301089 A1 * 12/2009 Bollinger ..... H02J 15/006 60/652
2010/0089063 A1 * 4/2010 McBride ..... F15B 11/032 60/682
2011/0109094 A1 * 5/2011 Kenway et al. ..... 290/55
2011/0142596 A1 * 6/2011 Nies ..... 137/1

FOREIGN PATENT DOCUMENTS

JP 59197601 11/1984
JP 64-058802 3/1989
JP 09504723 5/1997
JP 2002301560 10/2002
WO 9513114 5/1995
WO WO 2010/097153 9/2010

* cited by examiner

EQUIPMENT COMPRISING AT LEAST ONE HYDROPNEUMATIC ACCUMULATOR WITH AUTOMATED MAINTENANCE

The invention relates to any equipment including one or several hydropneumatic accumulators and more particularly relates to an enhancement allowing said or each accumulator to be maintained in an optimum operating condition automatically, all along its lifetime. The invention notably applies to any equipment equipped with one or several hydropneumatic accumulators located in an environment with limited and/or hazardous access and/or not tolerating frequent interventions because for example of a high duty cycle and/or a prohibitive cost in maintenance.

A hydropneumatic accumulator consists of a rigid container in which two compartments are defined: one compartment filled with pressurized gas commonly called «gas space» and a compartment filled with liquid, commonly called «liquid space». A separator with a flexible membrane forms a common deformable wall between both compartments.

The gas space includes a valve located at a corresponding end of the rigid container, through which a certain amount of pressurized gas may be injected and confined therein. This load of the gas space determines a certain operating range of the accumulator.

The applications are numerous. Among the latter, mention may be made of storage of «anti-pulsation» energy for absorbing peaks of pressure. Mention may also be made of braking assistance notably in a landing gear or on the contrary recovering energy such as for example in a truck wherein energy is recovered during a braking phase and restored during resumption of acceleration. Another field of application more particularly concerned by the invention is that of wind turbines. Such accumulators are used for feathering the blades of the wind turbine in the case of an emergency stop. In this case, the accumulators are installed in the rotary portion of the wind turbine, i.e. in a location which is particularly difficult to access.

The quality of the valves and of the permeation levels of the constitutive materials of a separator with a flexible membrane in principle allow the load of the latter to be maintained for quite a long period of time. However, it is not possible to completely avoid any small gas leaks and therefore, in the long run, a drop in the efficiency of the accumulator. This is why it is necessary to reload the gas space from time to time. To do this, connecting a pressurized gas source to the valve is known, for example by making available to the maintenance personnel, a mobile tank containing pressurized gas.

Among the applications mentioned above, there are those for which this «manual» reloading becomes a delicate, or even highly restrictive and/or hazardous operation.

With the invention, it is possible to solve this problem by providing a possibility of automatically loading the gas space.

More particularly, the invention relates to equipment including at least one hydropneumatic accumulator comprising a liquid space and a preloaded gas space, filled with gas at a pressure above a selected minimum value, characterized in that it comprises means for successive readjustment of the load of said gas space when the pressure of said load falls below the selected minimum value, comprising a pressurized gas source connected via an air system with a valve for loading said gas space, said air system including at least one reinjection solenoid valve with two positions, of the normally closed type, controlled by a unit for calculating successive cycles for reinjecting gas into the gas space, in that said calculation unit receives at least one signal representative of the hydraulic pressure prevailing in the liquid space or of the hydraulic power delivered by the latter and in that a control output of said calculation unit controls the successive opening and closing cycles of said reinjection solenoid valve by generating successive cycles for readjusting the load of said gas space every time its pressure falls below said selected minimum value.

In the air system and more particularly between the pressurized gas source and the reinjection valve(s), a reducing valve controlling the pressure of the gas delivered by the pressurized gas source, an adjustable nozzle (for adjusting the loading time) and an anti-return valve may be found. Preferably, these elements are connected in series and in this order.

According to certain embodiments, a flowmeter may be inserted into the air system, for determining an amount of reinjected gas during an aforementioned reinjection cycle. This flowmeter includes a signal output connected to the calculation unit, which is designed for determining the amount of reinjected gas from continuous measurement of the flow rate.

According to another possibility, the calculation unit includes a trigger input capable of receiving a signal representative of a readjustment order of the load of the gas space.

According to a possible embodiment, a pressure sensor is provided for measuring the pressure prevailing in the gas space, the output of which is connected to a data input of said calculation unit, for determining said amount of gas to be reinjected. In other words, gas is reinjected during a reinjection cycle, until the pressure prevailing in the gas space again reaches a desired value.

The equipment may also be characterized in that it includes a temperature sensor for measuring the temperature of the gas of said gas space, the output of which is connected to a data input of said calculation unit, for determining said amount of gas to be reinjected.

As this will be seen later on, the measurement of the temperature of the gas is involved as a correction value for determining the value of the pressure in the gas space for which reinjection is stopped.

According to another alternative, the equipment includes several accumulators or groups of accumulators and corresponding reinjection valves. The air system is connected to all the reinjection valves and the calculation unit includes respective control outputs connected for independently driving said reinjection valves. Thus, a reinjection cycle may only concern at a given moment a single accumulator or groups of accumulators, in spite of a single pressurized gas source and a common air system.

Optionally, such a group of accumulators associated with a same reinjection valve consists of several accumulators connected in parallel.

According to another advantageous feature, the equipment further includes a purging valve of the normally open type connected to said or each aforementioned loading valve and controlled upon closing by the calculation means during an aforementioned reinjection cycle.

According to an alternative, this purging valve may be unique. In this case, it is connected to the aforementioned air system, directly upstream from the reinjection valve(s). It is also controlled upon closing during a reinjection cycle.

Advantageously, said pressurized gas source includes at least one tank of compressed gas. This tank will preferably be placed in an accessible location so as to be easily replaced. The pressure of the gas in such a tank is greater than the maximum pressure for preloading the hydropneumatic accumulator(s).

The invention will be better understood and other features thereof will become more clearly apparent in the light of the description which follows of several embodiments of equipment according to its principle, only given as an example and made with reference to the appended drawings, wherein.

Figure 1:
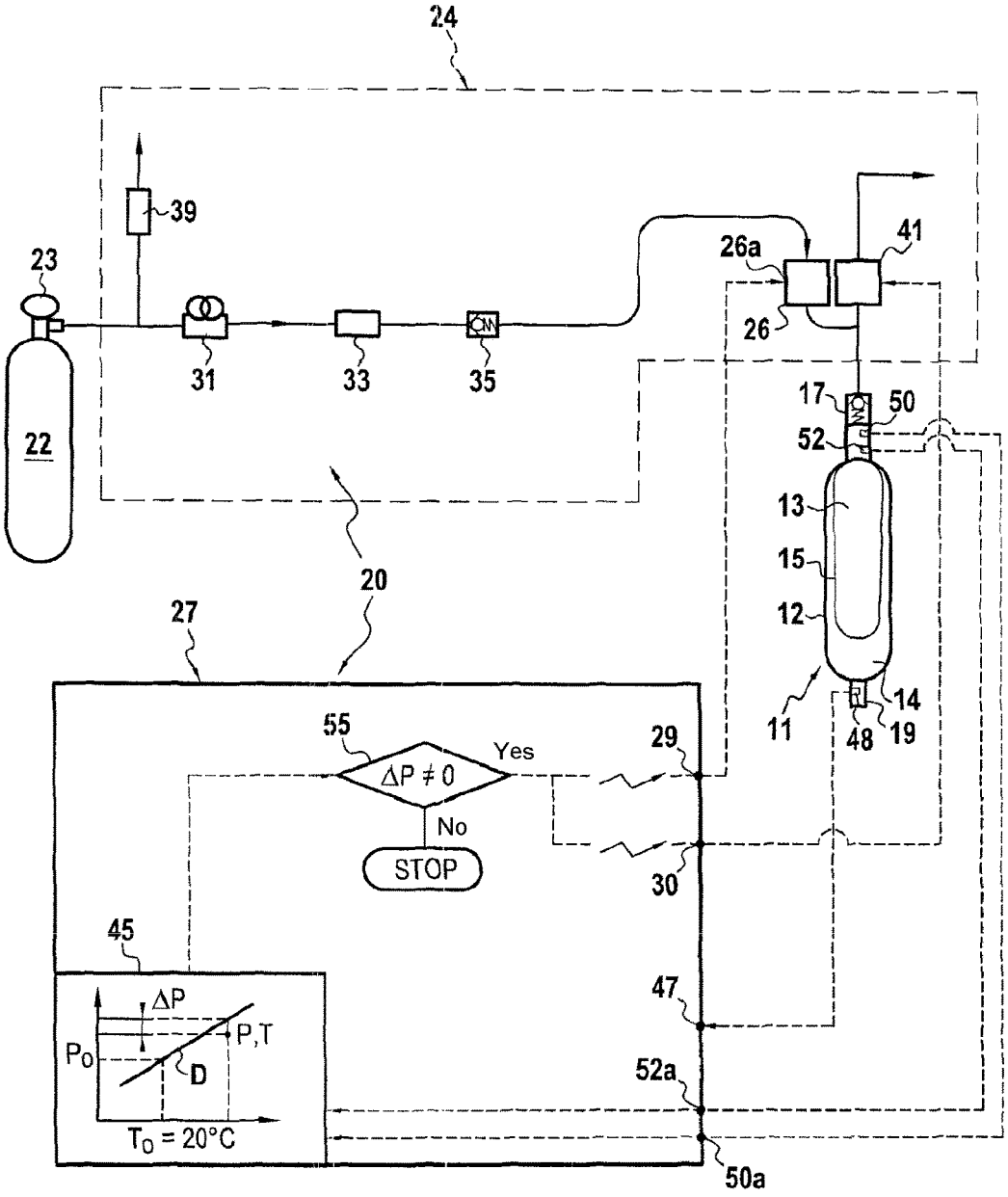
FIG. 1 is a block diagram of a first possible embodiment of the equipment according to the invention.

The equipment illustrated in FIG. 1 includes at least one hydropneumatic accumulator 11 conventionally comprising a rigid container 12 in which a gas space 13 and a liquid space 14 are defined. Both of these spaces of variable volumes share the internal volume of the container 12. They include a common wall formed by a separator with a flexible membrane 15. A predetermined amount of pressurized gas is confined in the gas space. A loading check-valve 17 communicates with the gas space and allows the loading of an intended amount of gas into the latter. In principle the gas is therefore found confined in said gas space. The liquid space includes an outlet 19 connected to a hydraulic circuit of use, not shown.

The equipment includes means 20 for readjusting the load of the gas space, connected to the loading check-valve 17. These readjustment means include a pressurized gas source 22 consisting here of a pressurized gas tank, an air system 24 notably including a controlled reinjection valve 26 of the normally closed type, and a unit 27 for calculating a cycle for reinjecting gas into the gas space. Said calculation unit 27 is provided for controlling the valve 26. According to a preferred example, the valve 26 is a solenoid valve, the electric signal input 26*a* of which is connected to a specific control output 29 of the calculation unit 27.

The outlet of the pressurized gas source 22 is equipped with a manually actuated isolating valve 23. The air system 24 extends between this valve 23 and the loading check-valve 17. It comprises, in series from the insulating valve 23, a reducing valve 31, an adjustable nozzle 33 and an anti return valve 35. The reducing valve allows control of the pressure of the gas delivered by the pressurized gas source; the nozzle allows adjustment of the loading time. The pressurized gas source 22 is a simple tank of compressed gas here, which may easily be changed.

The outlet of the anti return valve 35 is connected to the pneumatic inlet of the valve 26. The pneumatic outlet of the valve 26 is connected to the loading check-valve 17.

A safety valve 39, for venting, is connected in one point between the insulating isolation valve 23 and the reducing valve 31.

A purging valve 41, here advantageously a solenoid valve, of the normally open type, is connected to said or each aforementioned loading check-valve 17 and controlled upon closing by the calculation unit 27. The solenoid valve 41 is connected so as to be driven by an output 30 of the calculation unit. It is driven upon closing at the beginning of a reinjection cycle.

The calculation unit 27 conventionally includes a microprocessor and electronic circuits capable of elaborating electric control signals for the solenoid valves 26 and 41, notably for receiving and processing signals stemming from various sensors, in order to allow the elaboration of electric control signals. This calculation unit will not be described in detail.

The application of the calculation unit 27 triggers a cycle for reinjecting gas into the gas space. To do this, it is driven, for starting this cycle and in the example of FIG. 1, by a signal representative of the hydraulic pressure prevailing in the liquid space 14. Thus, according to the example, a cycle triggering input 47 is connected to the output of a pressure sensor 48 of the liquid space. When this pressure reaches a low threshold, the calculation unit 27 transmits driving signals to the outputs 30 and 29 for successively closing the solenoid valve 41 and opening the solenoid valve 26, respectively.

The calculation unit 27 notably includes a compensation circuit 45 giving the possibility of adapting the amount of reinjected gas depending on the pressure and on the temperature of the gas (as compared with reference values) contained in said gas space, by means of pressure sensors 50 and temperature sensors 52, placed in contact with the gas of said gas space downstream from the check-valve 17. More specifically, the pressure sensor 50 measures the pressure prevailing in the gas space and its output is connected to a data input 50*a* of said calculation unit 27 for determining the amount of gas to be reinjected. Also, the temperature sensor 52 gives the possibility of measuring the temperature of the gas in the gas space and its output is connected to a data input 52*a* of said calculation unit for determining the amount of gas to be reinjected.

The compensation circuit 45 contains in memory the normal variations of the pressure P according to the temperature T in the gas space, by assuming that the latter is at its predetermined rated load depending on the characteristics of the equipment where the accumulator 11 is put to use. In FIG. 1, these variations are schematized by a straight line D.

If the input 47 receives an order for triggering the reinjection cycle elaborated from the sensor 48, the compensation circuit 45 receives from the sensors 50 and 52, representative information of the actual pressure and temperature in the gas space. This allows determination of a point (P, T) shifted from the straight line D, from which results the determination of a value $\Delta P$, to be corrected. This value is loaded in a suitable piece of software which repeatedly carries out a test 55 on the value of $\Delta P$, in order to elaborate driving signals which are sent to the outputs 29 and 30. More specifically, as long as the test $\Delta P$ #0 is positive, the valve 26 is maintained open and the valve 41 is maintained closed, which allows continuous reloading of the gas space with gas from the pressurized gas source. When the test 55 becomes negative i.e. $\Delta P=0$, the driving signals disappear and the solenoid valve 26 closes while the solenoid valve 41 opens putting the inlet of the check-valve 17 in contact with the atmosphere.

While the cycle for reinjecting the pressurized gas is delivered by the gas source 22 (the isolation valve 23 being open) the safety valve 39 remains closed. This gas flows under the control of the reducing valve 31 and of the adjustable nozzle 33. It crosses the anti return valve 35 and the solenoid valves 26 for reloading the gas space 13 by forcing the check-valve 17 until the value $\Delta P$ determined by the calculation unit 27 (more specifically the compensation circuit 45) is brought back to zero.

Figure 2:
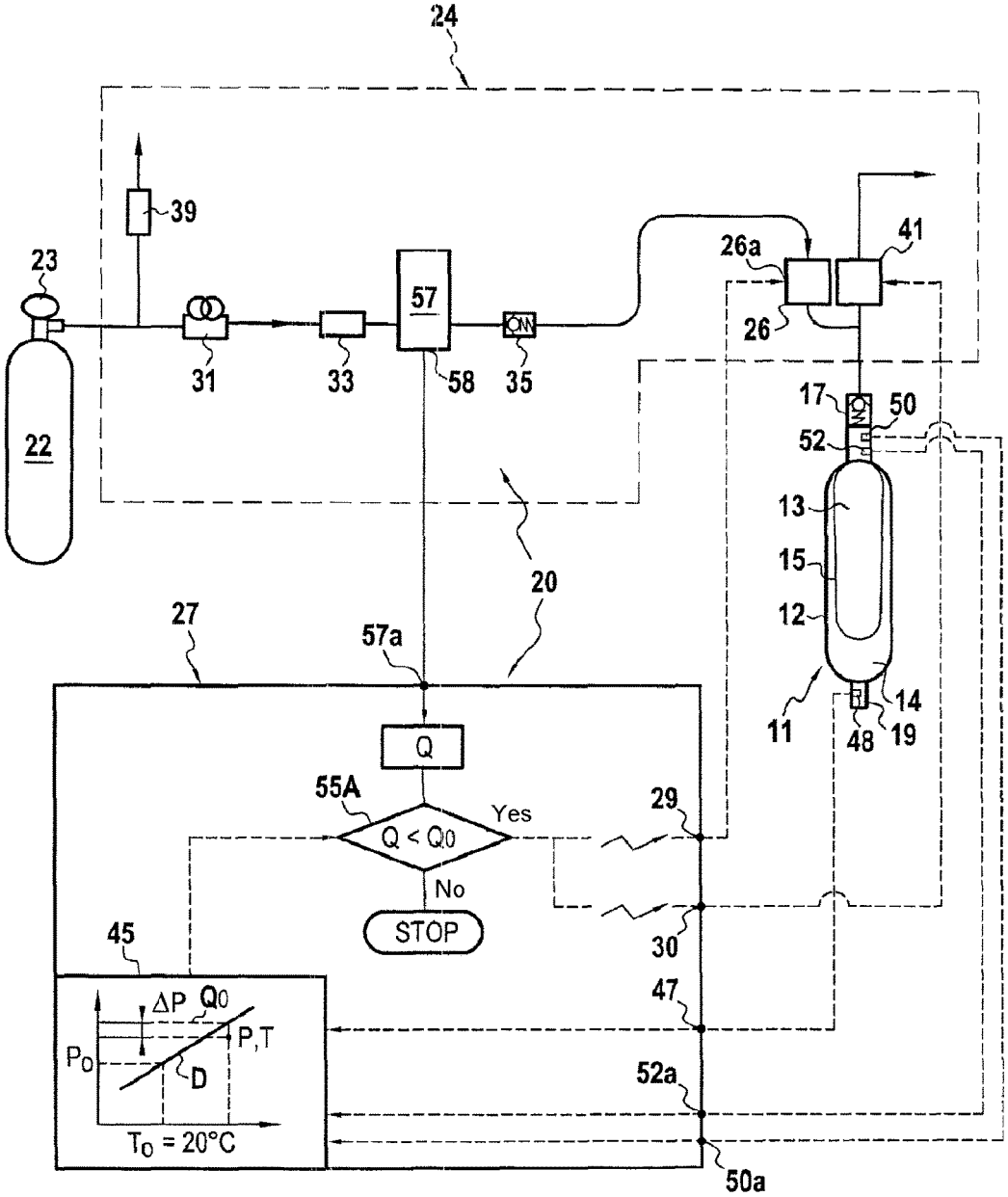
FIG. 2 is a similar block diagram illustrating one alternative.

In FIG. 2 illustrating an alternative, the elements similar to those described with reference to FIG. 1 bear the same numerical references and will not be described again.

This alternative is characterized in that it includes a flowmeter 57 inserted into the air system. The flowmeter includes a signal output connected to the calculation unit for determining an amount of reinjected gas during an aforementioned reinjection cycle.

The calculation unit 27 is globally similar to that of FIG. 1 but the compensation circuit is provided for inferring, notably from the value ΔP acquired like earlier, a value $Q_0$ representative of the amount of gas to be reinjected for reloading the gas space 13. The amount of reinjected gas Q is determined by the calculation unit 27 from the flow rate information applied to a data input 57*a* connected to the signal output 58 of the flowmeter 57. A suitable piece of software repeatedly carries out a test 55A elaborating driving signals available on the outputs 29 and 30. This test compares the value Q of the amount of gas introduced since the beginning of the reinjection cycle in the gas space (a value inferred from the flowmeter 57) with the value $Q_0$ determined by the compensation circuit 45. The order for triggering the reinjection cycle is like in the previous example, elaborated from a measurement (sensor 48) of pressure of the liquid space.

Figure 3:
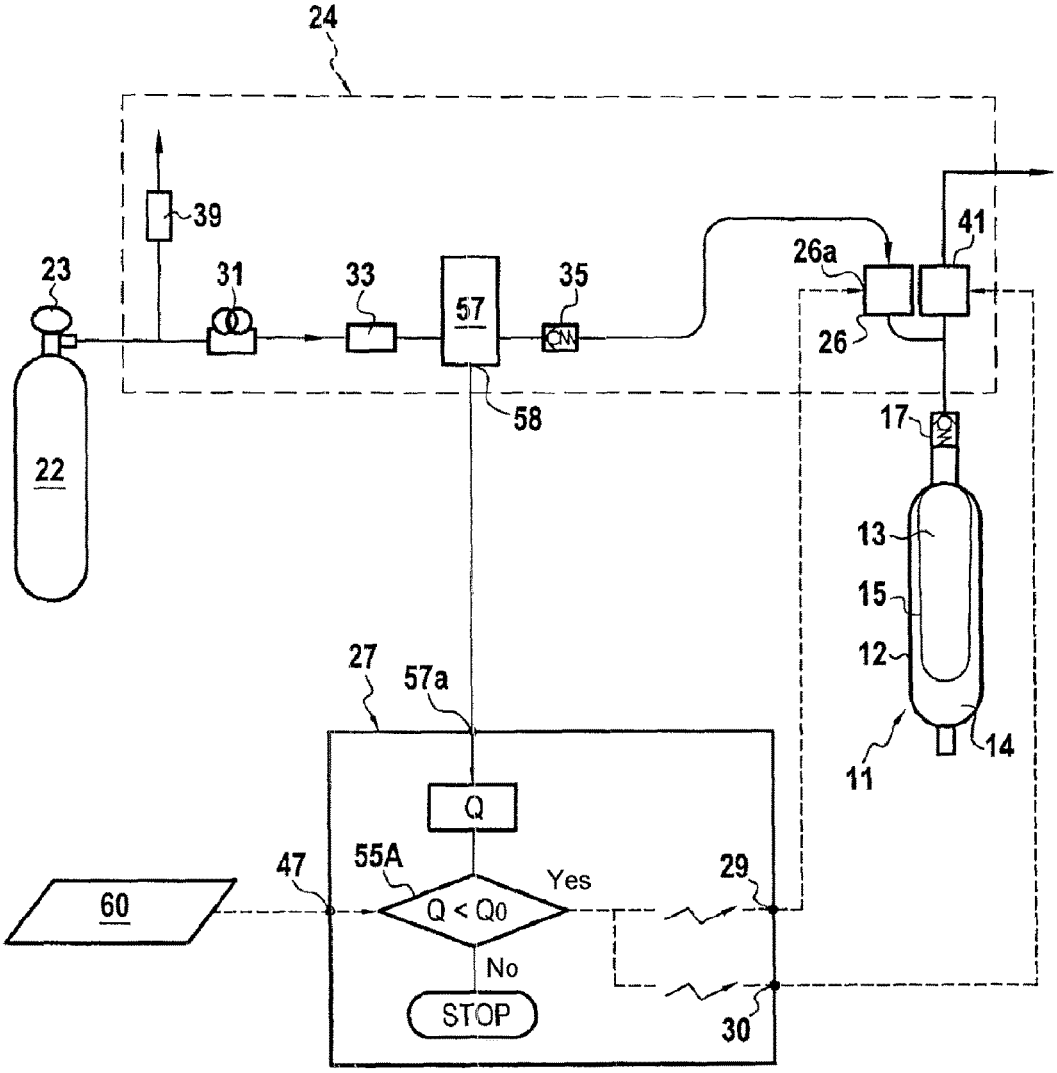
FIG. 3 is a block diagram illustrating another embodiment of the equipment.

In the example of FIG. 3, the essential elements of the equipment of FIG. 2 are again found, notably the flowmeter 57 inserted into the air system 24 by means of which the calculation unit may determine in real time the amount of gas Q reinjected into the gas space at any moment of the reinjection cycle. This cycle begins and ends with the actuation of the solenoid valves 26, 41 like in the two previous embodiments.

However, in this example, the cycle is not triggered by the detection of insufficient pressure in the liquid space but by the dedicated electronic assembly 60 triggered by a representative signal of the hydraulic power delivered to the equipment to which the hydropneumatic accumulator 11 is connected. The design of this electronic assembly depends on the type of relevant equipment and is within the reach of one skilled in the art. If the measured hydraulic power reaches a certain low threshold, the dedicated electronic assembly 60 elaborates a signal for triggering a cycle, applied to the triggering input 47 which drives the calculation unit 27.

This may be simplified by determining a priori and once and for all an amount of gas $Q_0$ to be reinjected into each reinjection cycle. In this case, the circuit 45 may be suppressed as well as the sensors 50, 52 and of course the sensor 48, the cycles being activated by the dedicated electronic assembly 60.

Of course, the type of triggering control described in FIG. 3 may also be adapted to the equipment of FIG. 1, without any flowmeter, by using the circuit 45 and the sensors 50, 52, i.e. by controlling the reinjected gas by cancelling out the value ΔP.

Figure 4:
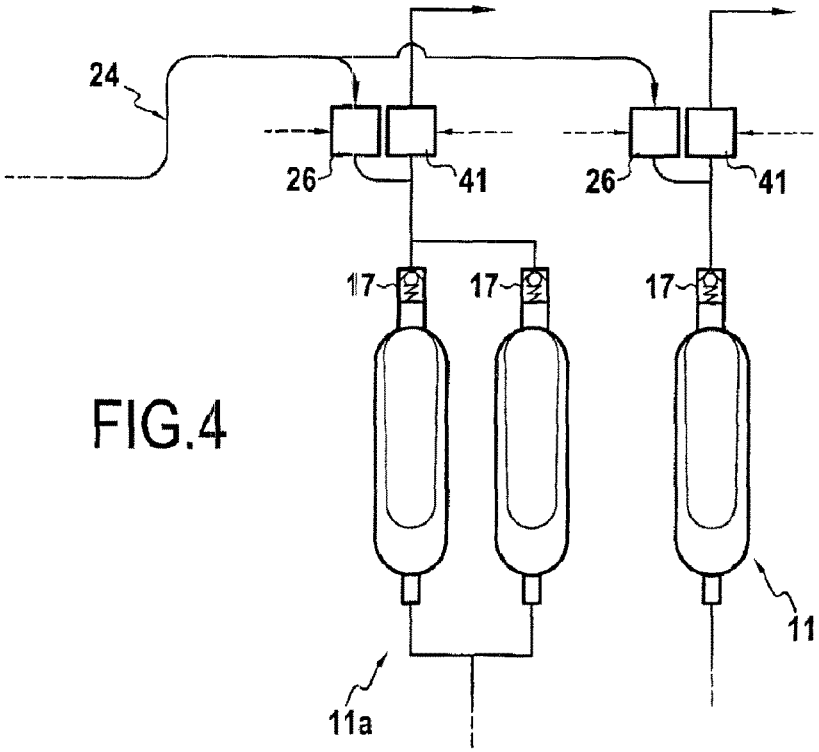
FIG. 4 is a partial block diagram illustrating a possibility of extension of the equipment.

In FIG. 4, equipment provided with several accumulators 11 or groups of accumulators 11*a* associated with corresponding reinjection valves is illustrated. As illustrated, a group of accumulators 11*a*, associated with a same reinjection valve 26 consists of several accumulators connected in parallel.

The air system 24 is connected to all the reinjection valves 26 while the calculation unit not shown includes respective control outputs connected for independently driving said reinjection valves.

In the example of FIG. 4, each accumulator 11 or group of accumulators 11*a* is associated with a specific purging valve 41 of the normally open type. Each valve is directly connected to each loading check-valve 17 and is controlled upon closing by the calculation unit during a reinjection cycle corresponding to the relevant accumulator or group of accumulators. Each valve 41 is controlled by a specific output of the calculation unit.

Figure 5:
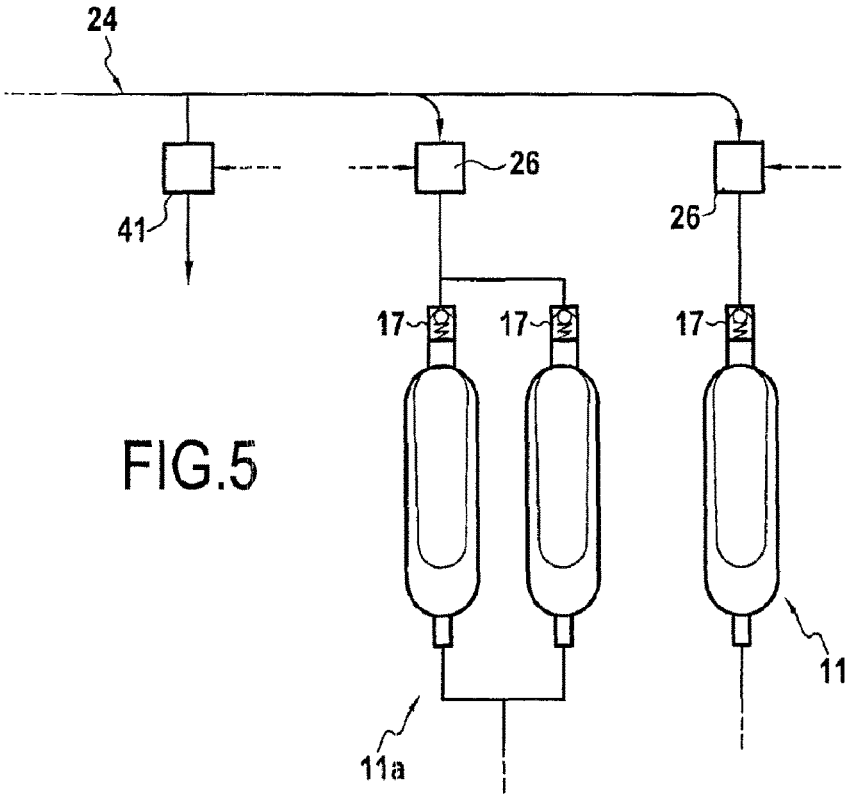
FIG. 5 is a view similar to FIG. 4, illustrating an alternative.

On the contrary, in the embodiment of FIG. 5, the purging valve 41 is unique. This valve normally open is connected to the air system 24 directly upstream from said or each reinjection valve. According to the example, it is therefore connected downstream from the anti-return valve 35. It is controlled upon closing during a reinjection cycle.

The invention claimed is:

1. A method for successive readjustments of a load of a gas space of a hydropneumatic accumulator when pressure of said load falls below a selected minimum value, comprising:

detecting a pressure of gas in the gas space of the hydropneumatic accumulator via a pressure sensor in contact with the gas in said gas space;

detecting a temperature of gas in the gas space of the hydropneumatic accumulator via a temperature sensor in contact with the gas in said gas space;

a control circuit communicating with the pressure sensor and the temperature sensor;

the control circuit comparing the pressure detected to pressures stored in a memory of the control circuit;

the control circuit determining an amount of gas to be injected into said gas space based on the pressure and the temperature detected; and the control circuit successively cycling opening and closing of a reinjection solenoid valve by generating successive cycles for readjusting the load of said gas space to adjust the load of the gas space when the pressure of said gas space falls below the selected minimum value.

2. An apparatus, comprising:

at least one hydropneumatic accumulator comprising a liquid space, and a preloaded gas space for being filled with a gas under a pressure greater than a selected minimum value;

an assembly for successive readjustments of a load of said gas space when the pressure of said load falls below the selected minimum value, said assembly comprising a pressurized gas source connected via an air system to a loading check-valve of said gas space, said air system including at least one reinjection solenoid valve with two positions, a normally closed position and an open position, wherein the loading check-valve allows flow of the gas from the pressurized gas source to the gas space and prevents flow of the gas from the gas space, the at least one reinjection solenoid valve is connected to and controlled by a calculation unit for successive cycles of reinjection of gas into said gas space, said at least one reinjection solenoid valve is disposed on a gas line extending from said pressurized gas source to said loading check-valve, wherein said calculation unit includes a compensation circuit and a memory that stores data for normal variations of the pressure according to a temperature in said gas space, and adapting an amount of said reinjection of gas to said gas space based on the pressure and on the temperature of the gas contained in said gas space, by a pressure sensor and a temperature sensor placed in contact with the gas of said gas space downstream from the at least one reinjection solenoid valve, said calculation unit receives at least one representative signal of the hydraulic pressure prevailing in the liquid space or of a hydraulic power delivered by the liquid space, and a control output of said calculation unit controls the successive cycles for opening and closing the at least one reinjection solenoid valve by generating successive cycles for readjusting the load of said gas space every time the pressure of the gas space falls below the selected minimum value; and a purging valve of a normally open type, said purging valve is connected to said loading check-valve and controlled to have a closed position by the calculation unit during a reinjection cycle.

3. The apparatus according to claim 2, further comprising a reducing valve in said air system.

4. The apparatus according to claim 2, further comprising an adjustable nozzle in said air system.

5. The apparatus according to claim 2, further comprising an anti-return valve in said air system.

6. The apparatus according to claim 2, wherein said air system between the pressurized gas source and the at least one reinjection solenoid valve includes the following elements in series:

a reducing valve controlling the pressure of the gas delivered by said pressurized gas source;

an adjustable nozzle; and an anti-return valve.

7. The apparatus according to claim 2, further comprising a flowmeter in said air system, said flowmeter including a signal output connected to said calculation unit, for determining a reinjected amount of gas during an reinjection cycle.

8. The apparatus according to claim 2, wherein the pressure sensor includes an output connected to a data input of said calculation unit, for determining said amount of gas to be reinjected.

9. The apparatus according to claim 2, wherein the temperature sensor includes an output connected to a data input of said calculation unit, for determining said amount of gas to be reinjected.

10. The apparatus according to claim 2, further comprising a plurality of the hydropneumatic accumulators, each one of the hydropneumatic accumulators having a corresponding one of the reinjection solenoid valves associated therewith, wherein said air system is connected to each one of the reinjection solenoid valves and wherein said calculation unit includes respective control outputs connected for independently driving each one of the reinjection solenoid valves.

11. The apparatus according to claim 10, wherein the hydropneumatic accumulators are connected in parallel.

12. The apparatus according to claim 2, wherein said pressurized gas source includes at least one tank of compressed gas, a pressure of said compressed gas in said at least one tank is greater than the selected minimum value.

13. An apparatus, comprising:

a hydropneumatic accumulator including:

a liquid space filled with a liquid, and a gas space filled with a gas at a pressure;

an assembly connected to the hydropneumatic accumulator for readjustments of a load of the gas in the gas space when the pressure of the gas in the gas space becomes below a selected minimum value, the assembly including:

a calculating unit, a loading check-valve connected to the gas space of the hydropneumatic accumulator, the loading check-valve allows flow of the gas into the gas space and prevents flow of the gas from the gas space, an air system connected to the loading check-valve, the air system including a reinjection solenoid valve having a normally closed position and an open position, a pressurized gas source connected to the loading check-valve, the reinjection solenoid valve is disposed on a gas line extending from the pressurized gas source to the loading check-valve, and a purging valve of a normally open type, the purging valve being connected to the loading check-valve, the purging valve being closed upon a control signal from the calculation unit, wherein the calculation unit receives at least one of a hydraulic pressure signal in the liquid space or a hydraulic power delivered by the liquid space, and when the pressure of the gas space falls below the selected minimum value, the calculation unit sends control outputs to actuate the reinjection solenoid valve to the open position and to actuate the purging valve to a closed position, so that the gas from the pressurized gas source flows into the gas space.

* * * * *